United States Patent [19]

Rautilo

[11] 4,302,918

[45] Dec. 1, 1981

[54] PLUG

[75] Inventor: Matti Rautilo, Hyryld, Finland

[73] Assignee: Paraisten Kalkki Oy - Pargas Kalk Ab., Nastola, Finland

[21] Appl. No.: 59,393

[22] Filed: Jul. 20, 1979

Related U.S. Application Data

[63] Continuation of Ser. No. 714,347, Aug. 16, 1976, abandoned.

[30] Foreign Application Priority Data

Aug. 20, 1975 [FI] Finland ..... 752361

[51] Int. Cl.[3] ..... E04C 2/04

[52] U.S. Cl. ..... 52/421; 52/302; 52/310; 138/89; 210/163

[58] Field of Search ..... 52/421, 303, 302, 310; 210/163-165; 285/DIG. 2; 138/89, 96 R, 96 T; 4/287, 288, 290, 292, 291, 295, DIG. 15

[56] References Cited

U.S. PATENT DOCUMENTS

| | | | |
|---|---|---|---|
| 638,580 | 12/1899 | Hennessey | 138/96 R |
| 1,310,055 | 7/1919 | Caldwell | 210/164 |
| 1,791,512 | 2/1931 | Schurman | 210/163 |
| 1,862,134 | 6/1932 | Boosey | 210/163 |
| 2,737,205 | 3/1956 | Stringfield | 138/89 |
| 3,161,360 | 12/1964 | Levine | 4/292 |
| 3,303,264 | 2/1967 | Saul | 52/221 |
| 3,321,080 | 5/1967 | Pansini | 4/290 |
| 3,378,858 | 4/1968 | Jacuzzi | 210/163 |
| 3,490,488 | 1/1970 | Grist | 138/89 |
| 3,701,450 | 10/1972 | Belzberg | 138/96 R |

FOREIGN PATENT DOCUMENTS

| | | | |
|---|---|---|---|
| 1063718 | 3/1967 | United Kingdom | 52/302 |

*Primary Examiner*—Price C. Faw, Jr.
*Assistant Examiner*—H. E. Raduazo
*Attorney, Agent, or Firm*—Burmeister, York, Palmatier, Hamby & Jones

[57] ABSTRACT

A plug adapted to be inserted into the open end of a channel of a concrete slab which is provided with a plug portion having a perimeter conforming to the cross section of the channel and of smaller diameter than the cross section of the channel, the plug being provided with outwardly extending fingers from the perimeter of the plug portion which are adapted to engage the surfaces of the channel, the fingers having arms extending therefrom which support a ring adapted to abut the exterior surface of the slab about the channel to accurately position the plug within the channel. The plug permits water to drain from the channels through slots between adjacent fingers and facilitates the use of mortar for joining the ends of adjacent slabs or the like.

5 Claims, 2 Drawing Figures

PLUG

Figure 1:
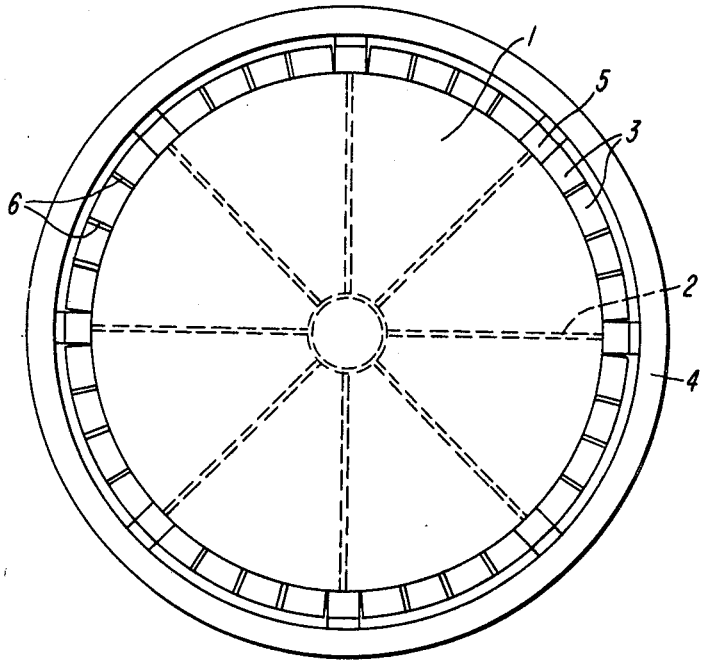

The subject of the present invention is a plug especially for blocking or closing the ends of the channels, also referred to as holes or cavities, in hollow slabs, generally circular or oval in cross section. The plug comprises a disk-shaped plug portion, whose shape corresponds to the cross-section of the holes or cavities in the hollow slab and from the edges of which portion limiter arms project substantially perpendicularly to the plane of the plug portion. The ends of which limiter arms are provided with curved limiter tongues, or limiter a rings, which project outwards towards the side and which are positioned in a plane parallel to the plane of the plug portion. When the plug is installed into the hole or cavity, the tongues or ring prevents the plug from becoming inclined and limit the position of the plug to a predetermined depth.

Hollow slabs of concrete are cast into continuous slabs, for example, by means of a glide-casting machine travelling in the horizontal plane on a 100 meter-long hose. From this, after the concrete has hardened, pieces of predetermined lengths are sawn for intermediate floors or buildings. Each slab may contain, for example, five circular channels. After installation, the slabs are jointed by means of concrete at the sides and at the ends. The channels or cavities must be blocked by means of plugs positioned into the cavities. The plug must lie in the cavity at a depth of 50 to 60 millimeters in order to obtain good adhesion of the jointing mortar to the slab, that is to provide the so-called peg effect.

The size of the channels or cavities varies, because the slab is cast by means of several separate casting machines. The size of the cavity is, moreover, affected by the age of the wearing parts of the machine; the more worn the parts, the smaller cavity. Quality fluctuations in the concrete mix cause changes in the dimensions of the cavity. If the mix is too moist, the cavity, which is supposed to become circular in cross section, may become a little oval.

Previously known plugs designed for closing the ends of the cavities of hollow slabs are plugs that comprise a circular disk-shaped plug portion and limiter arms that limit the position of the plug to a predetermined depth.

In the case of the polystyrene and mineral-wool plugs used at present, said dimensional deviations cause difficulties. Especially polystyrene plugs are commonly broken as a result of attempts to press them into an excessively small or oval hole. The material of polystyrene plugs is too brittle so that a plug can be sufficiently tight within the channels of a slab in order to maintain its position reliably. This is why such plugs become loose from larger holes during transport and jointing.

Mineral-wool plugs absorb water. When they become wet, they become soft, which results in loosening during jointing.

During storage and transportation, water is accumulated into the cavities, which water cannot by-pass either one of the known plugs. The water causes loosening of the dressing agent and paint from the bottom face of the finished structure.

The objective of the present invention is to eliminate the above drawbacks, and the plug in accordance with the invention is characterized in that resilient curved tongues placed in the plane of the plug portion are arranged so that they project from the edge of the disk-shaped plug portion, between which tongues slits or openings are arranged which permit draining of water that has come into the cavities, through the plug placed into the channel.

By means of plugs made in accordance with the invention, remarkable advantages are obtained as compared with previously known plug constructions.

The plug remains fixedly in position, because the tongues bend to permit the plug to be pushed into the channel but do not permit the plug to be readily retracted.

The limiters prevent the plug from being pressed too deeply.

The slits between the tongues permit draining of any water entering into the cavities, whereby water damage is avoided.

The plug does not cover the adhesion point of the jointing mix at the end of the slab.

The support ribs of the plug are placed facing towards the slab, for which reason the outer face of the plug is a flat face, whereby it is possible to make any markings to be applied onto the slab by text marker pen or by stamp on the plug. This can be performed in advance, whereby the previously marked plug may be pushed into the end of the slab.

Figure 2:
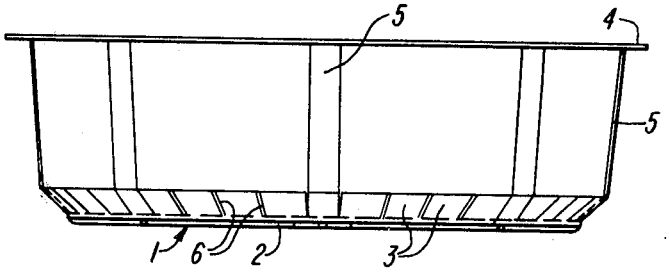

The invention may be more fully understood from the following description and from the attached drawing, which:

FIG. 1 is a plan view of a plug in accordance with the invention as viewed from the side of the limiters; and FIG. 2 is a side elevational view of the plug of FIG. 1.

The plug can be manufactured of an elastic material suitable for the purpose, such as HD-polythene or corresponding tough plastics by die-casting. The plug comprises a circular disk-shaped plug portion 1 provided with support ribs 2 extending radially on one side thereof. Elastic tongues 3 disposed in the plane of the plug portion 1 project outwardly from the edge of the plug portion 1 and are provided with a curved outer fastening edge. The tongues become thinner from the perimeter of the plug portion 1 towards the fastening edge of the tongues 3. In use, the edge of the tongues 3 engage the wall of the channel. Further the slanted tongues are in the direction of insertion. Radial slits or openings 6 are disposed between the tongues 3, which slits or openings permit draining of water that may be in the cavities.

Limiter arms 5 project from the edges of the plug portion 1 substantially perpendicularly to the place of the plug portion 1. The ends the arms are provided with a flat limiter ring 4 projecting outwardly and disposed in a plane parallel with the plane of the plug portion.

The installation of the plug at the end of a hole or cavity of a hollow slab takes place simply by pressing. The diameter of the hole or cavity is larger than the diameter of the disk portion 1 of the plug but smaller than the diameter of the circle determined by the edges of the plug tongues 3. On insertion, the tongues 3, thinner towards the edges, bend against the wall of the cavity and grasp the wall of the cavity, thereby preventing removal of the plug from the cavity. On the other hand, the limiter arms 5 and the limiter ring 4 at their ends, prevent the plug from being pressed too deeply into the cavity, since the limiter ring 4 is supported against the end of the slab. The limiters also prevent inclining of the plug when the plug is installed.

The support ribs 2 projecting from the surface of the plug portion 1 are placed facing towards the slab, so that the outer face of the plug remains a straight, smooth plane face, on which it is possible to write or stamp the sign, work number, date of manufacture, length, etc. of the slab.

The invention is, of course, not restricted to the exemplifying embodiment described above alone, but in its details it may show variety in many ways within the scope of the patent claims. Thus, the shape of the plugs corresponds to the cross-sectional shape of the cavities of the hollow slab, whereby the shape of the plugs may also be different from the round shape described in the drawing by way of example.

What we claim is:

1. A plug adapted to be inserted into the ends of a channel in a slab and engage the wall of the channel comprising a unitary structure of plastic material having a flat disk-shaped portion with a perimeter corresponding in shape to the cross-section of the channel in the slab, the perimeter of said disk-portion being smaller than the cross-section of the channel in the slab, said unitary structure having a plurality of elongated fingers extending from the perimeter of the disk-portion, each of said fingers being planar and extending at an acute angle to the disk-portion, said fingers diverging from a central axis traversing normally the center of the disk-portion and being spaced from each other to form slots through therebetween, which permit water to drain freely through the plug said fingers extending from the disk-portion to a surface corresponding in shape to the channel and having a cross-section greater than the cross-section of the channel, and said fingers being resiliently yieldable to forces exerted thereon in a direction toward the central axis of the disk-portion, whereby insertion of the plug into the channel distorts the fingers, a plurality of limiter arms, means mounting the limiter arms on the disk-portion and positioning said arms generally normal to the disk-portion, and an outwardly extending projection on the end of each of the limiter arms adapted to engage the surface of the slab when the plug is fully inserted into a channel thereof.

2. A plug comprising the combination of claim 1 wherein the outwardly extending projection on each of the limiter arms comprises a flat ring mounted on all of the limiter arms parallel to the disk portion.

3. A plug comprising the combination of claim 2 wherein each of the fingers is linear and extends from the perimeter of the disk-portion at an acute angle to the plane of the disk-portion and wherein each of the limiter arms extends from the end of one of the fingers opposite the disk-portion.

4. A plug comprising the combination of claim 3 wherein the disk-portion is flat and provided with a plurality of ribs on the surface confronting the limiter arms, said ribs extending radially inwardly from the perimeter thereof.

5. A concrete assembly for the construction of building structures comprising a concrete slab having a wall with an opening therein and a channel extending therein from the opening, a unitary structure of plastic disposed in the opening, said unitary structure comprising a flat disk-shaped portion with a perimeter corresponding in shape to the cross-section of the channel in the slab, the perimeter of said disk-portion being smaller than the cross-section of the channel in the slab, said unitary structure having a plurality of elongated fingers extending from the perimeter of the disk-portion, each of said fingers being at an acute angle to the disk-portion, said fingers diverging from a central axis traversing normally the center of the disk-portion and being spaced from each other to form slots through therebetween which permit water to drain freely through the plug said fingers extending from the disk-portion to a surface corresponding in shape to the channel and having a cross-section greater than the cross-section of the channel, and said fingers being resiliently yieldable to forces exerted thereon in a direction toward the central axis of the disk-portion and engaging the channel, a plurality of limiter arms, each of said limiter arms extending from the end of one of the fingers opposite the disk-portion, and an outwardly extending projection on the end of each of the limiter arms engaging the surface of the slab adjacent to the opening.

* * * * *

UNITED STATES PATENT AND TRADEMARK OFFICE

CERTIFICATE OF CORRECTION

PATENT NO. : 4,302,918

DATED : December 1, 1981

INVENTOR(S) : Matti Rautilo

It is certified that error appears in the above-identified patent and that said Letters Patent are hereby corrected as shown below:

Col. 1, line 23
Delete "hose". Insert -- base --.

Col. 1, line 25.
After "floors" delete "or" insert -- of --

Col. 2, line 27
Delete "which" -- insert -- wherein --

Col. 2, line 43
End of line, delete "slanted"

Col. 2, line 44
After "are" insert -- slanted --.

Claim 5, line 26
After "being" insert -- planar and extending --

Signed and Sealed this

*Thirtieth* Day of *March 1982*

[SEAL]

*Attest:*

GERALD J. MOSSINGHOFF

*Attesting Officer* *Commissioner of Patents and Trademarks*